US005334320A

United States Patent [19]

Tomizawa et al.

[11] Patent Number: 5,334,320

[45] Date of Patent: Aug. 2, 1994

[54] COMPOSITIONS FOR HYDRAULIC, LUBRICATING AND COUPLING

[75] Inventors: Hirotaka Tomizawa, Tokorozawa; Noboru Umemoto, Kamifukuoka; Hitoshi Ohenoki, Sayama, all of Japan

[73] Assignee: Tonen Corporation, Tokyo, Japan

[21] Appl. No.: 3,687

[22] Filed: Jan. 13, 1993

Related U.S. Application Data

[63] Continuation of Ser. No. 717,218, Jun. 20, 1991, abandoned.

[30] Foreign Application Priority Data

| | | | |
|---|---|---|---|
| Jun. 29, 1990 | [JP] | Japan | 2-172043 |
| Jun. 29, 1990 | [JP] | Japan | 2-172044 |
| Mar. 30, 1991 | [JP] | Japan | 3-067450 |
| Apr. 23, 1991 | [JP] | Japan | 3-092155 |

[51] Int. Cl.[5] ..... C10M 105/76

[52] U.S. Cl. ..... 252/46.6; 252/49.6; 252/78.3; 252/78.5

[58] Field of Search ..... 252/49.6, 49.8, 46.6, 252/78.3, 78.5

[56] References Cited

U.S. PATENT DOCUMENTS

| | | | |
|---|---|---|---|
| 2,996,453 | 8/1961 | Peale | 252/49.8 |
| 3,350,348 | 10/1967 | Braid | 252/46.6 |
| 3,499,839 | 3/1970 | Boehm | 252/33.4 |
| 3,532,730 | 10/1970 | Culpepper | 260/448.2 |
| 3,567,638 | 3/1971 | Braid | 252/46.6 |
| 3,646,172 | 2/1972 | Myers | 252/46.6 |
| 3,914,179 | 10/1975 | Byford et al. | 252/32.5 |
| 4,544,492 | 10/1985 | Zinke et al. | 252/32.7 E |
| 4,652,386 | 3/1987 | Alberts | 252/49.6 |

FOREIGN PATENT DOCUMENTS

| | | |
|---|---|---|
| 0125209 | 11/1984 | European Pat. Off. . |
| 0397507 | 11/1990 | European Pat. Off. . |
| 1518992 | 7/1978 | United Kingdom . |
| 2206887A | 1/1989 | United Kingdom . |

OTHER PUBLICATIONS

Patent Abstracts of Japan, vol. 14, No. 290 (C-0731), Jun. 22, 1990 and JP-A-2 091 196 Cosmo Oil Co. Mar. 30, 1990.

*Primary Examiner*—Jacqueline V. Howard
*Attorney, Agent, or Firm*—Nixon & Vanderhye

[57] ABSTRACT

A composition for hydraulic, lubricating and coupling is disclosed herein, which comprises organopolysiloxane and as an anti-wear agent at least one compound selected from those of the general formulas (I) to (IV), or an anti-wear agent of at least one compound selected from those of the general formulas (I) to (IV) together with a storage stabilizer. A composition for hydraulic, lubricating and coupling is also disclosed herein, which comprises organopolysiloxane together with a combination of two or more compounds selected from those of the general formulas (V) and (VI) as an anti-wear agent, or a combination of at least one compound selected from those of the general formulas (V) and (VI) as an anti-wear agent and a storage stabilizer. If necessary, the composition according to the present invention further comprises an antioxidant. The composition according to the present invention can be used at high temperature for a long period, without showing a significant increase in viscosity.

2 Claims, No Drawings

COMPOSITIONS FOR HYDRAULIC, LUBRICATING AND COUPLING

This is a continuation of application Ser. No. 07/717,218, filed Jun. 20, 1991, now abandoned.

FIELD OF THE INVENTION

The present invention relates to a composition for hydraulic, lubricating and coupling. More particularly, it relates to the composition for hydraulic, lubricating and coupling, which improves the thermal stability, whereby it can be used at high temperature for a long period without a significant increase in viscosity.

BACKGROUND OF THE INVENTION

For example, in the viscous coupling, a plurality of inner metal discs movably disposed on a driving shaft and a plurality of outer metal discs fixed on a driven shaft with predetermined spacings are combined together alternately and are accommodated in a housing, which fills a viscous operating oil for torque transmission. Under such an arrangement, a shearing force, i.e. a shear torque, is generated in the discs due to the difference in the rotation speed between the driving shaft and the driven shaft, whereby the torque is transmitted to the driven shaft.

As the operating oil for viscous coupling, organopolysiloxane such as dimethylpolysiloxane and methylphenylpolysiloxane, generally having high viscosity index, is used. The organopolysiloxane is easily subjected to thermal degradation or gelation when used at high temperature because of its poor thermal stability, whereby its viscosity increases and its torque transmission ability cannot be maintained stably.

For improving the thermal stability of organopolysiloxane, it has been proposed to add an antioxidant such as iron octoate, aromatic amine derivatives and ferrocene derivatives in organopolysiloxane. When the composition comprising organopolysiloxane and the antioxidant was practically used in a viscous coupling, however, the increase in viscosity was observed.

SUMMARY OF THE INVENTION

An object of the present invention is to provide a composition for hydraulic, lubricating and coupling, especially for a viscous coupling, whose viscosity increases very slightly even when used at high temperature for a long period.

The present inventors have investigated the reason which causes the increase in viscosity of the composition for viscous coupling and as the result, they supposed that the fresh surfaces of the metal discs, which are produced by wearing during the mutual contact of the metal discs, will catalyze the degradation of organopolysiloxane, whereby the viscosity will increase.

Now, the present inventors found that by adding a specific anti-wear agent of phosphorus type, if necessary together with a storage stabilizer in organopolysiloxane, coatings are formed on the fresh metal surfaces so as to control the catalyzing action of the fresh metal surfaces, whereby the increase in viscosity of the composition can be effectively prevented. Further, they found that by adding the combination of the known anti-wear agents or the combination of the known anti-wear agent and a storage stabilizer in organopolysiloxane, the same effect can be obtained.

Accordingly, the first aspect of the present invention provides a composition for hydraulic, lubricating and coupling, which comprises organopolysiloxane and the anti-wear agent of phosphorus type specified below, if necessary together with the storage stabilizer. The second aspect of the present invention provides a composition for hydraulic, lubricating and coupling, which comprises organopolysiloxane together with the combination of the known anti-wear agents or the combination of the known anti-wear agent and the storage stabilizer.

DETAILED EXPLANATION OF THE INVENTION

The organopolysiloxane, which is used as a base oil in the composition according to the present invention, has the following formula:

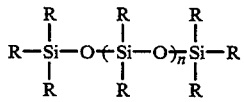

wherein each R represents hydrocarbon groups containing 1 to 18 carbon atoms, which may be halogenated, and n is an integer of 1 to 3,000, preferably an integer of 1 to 2,000.

Examples of suitable hydrocarbon groups include alkyl groups such as methyl, ethyl, n-propyl, i-propyl, n-butyl, i-butyl, t-butyl, n-pentyl, neopentyl, hexyl, heptyl, octyl, decyl and octadecyl; aryl groups such as phenyl and naphthyl; aralkyl groups such as benzyl, 1-phenylethyl and 2-phenylethyl; araryl groups such as o-, m- and p-diphenyl. Methyl and phenyl groups are preferable. Examples of suitable halogenated hydrocarbon groups include o-, m- and p-chlorophenyl, o-, m- and p-bromophenyl, 3,3,3-trifluoropropyl, 1,1,1,3,3,3-hexafluoro-2-propyl, heptafluoro-i-propyl, heptafluoro-n-propyl and trifluoromethylphenyl. Fluorinated aromatic or aliphatic saturated hydrocarbon groups containing 1 to 8 carbon atoms are preferable.

The organopolysiloxane can be used as a mixture, such as a mixture of methylpolysiloxane and phenylpolysiloxane.

Preferably, the organopolysiloxane having the viscosity of 1000 to 300,000 cSt (25° C.) is used.

The anti-wear agent of phosphorus type, which is added together with the organosiioxane in the first composition according to the present invention, is at least one selected from those of the following general formulas (I) to (IV).

Compound of the general formula (I):

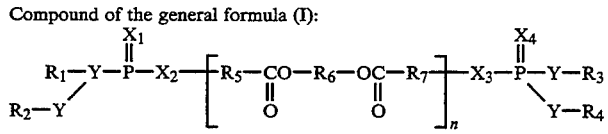

wherein each of $R_1$ to $R_4$ is hydrogen or monovalent hydrocarbon groups containing 1 to 20 carbon atoms, preferably linear and branched alkyl groups, aryl groups, aralkyl groups, araryl groups and halogenated hydrocarbon groups; each of $R_5$ to $R_7$ is divalent hydrocarbon groups containing 1 to 6 carbon atoms, preferably linear and branched alkyl groups, aryl groups, aralkyl groups, araryl groups and halogenated hydrocarbon groups; each of $X_1$ to $X_4$ is oxygen or sulfur; and Y is either absent or oxygen or sulfur; n is an integer of 0 to 2, provided that both $X_2$ and $X_3$ are sulfur when n is 0.

The description "Y is absent" herein means that $R_1$ to $R_4$ are linked to phosphorus atom directly (not through Y).

Compound of the general formula (II):

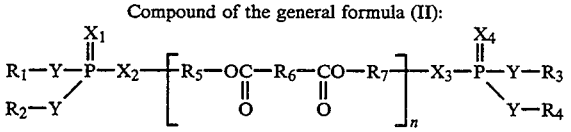

wherein $R_1$ to $R_7$, $X_1$ to $X_4$, Y and n are as defined in formula (I).

Compound of the general formula (III):

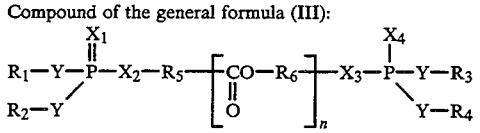

wherein each of $R_1$ to $R_4$ is hydrogen or monovalent hydrocarbon groups containing 1 to 20 carbon atoms, preferably linear and branched alkyl groups, aryl groups, aralkyl groups, araryl groups and halogenated hydrocarbon groups; each of $R_5$ and $R_6$ is divalent hydrocarbon groups containing 1 to 6 carbon atoms, preferably linear and branched alkyl groups, aryl groups, aralkyl groups, araryl groups and halogenated hydrocarbon groups; each of $X_1$ to $X_4$ is oxygen or sulfur; and Y is either absent or oxygen or sulfur; n is an integer of 0 to 2.

Compound of the general formula (IV):

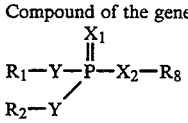

wherein each of $R_1$ and $R_2$ is hydrogen or monovalent hydrocarbon groups containing 1 to 20 carbon atoms; $R_8$ is hydrocarbon groups containing 1 to 20 carbon atoms and containing at least one ester bond; each of $X_1$ and $X_2$ is oxygen or sulfur; and Y is either absent or oxygen or sulfur.

$R_1$ to $R_4$ in the general formulas (I) to (IV) are preferably phenyl and alkylphenyl, considering the heat-resistance.

$R_1$ to $R_8$ in the general formulas (I) to (IV) contain preferably 1 to 10 carbon atoms, considering their surface adsorbing properties on metals and their solubility in organopolysiloxane.

The composition according to the present invention can contain one or more known anti-wear agents, which may be phosphorus type or sulfur type, in combination with the above anti-wear agent. The known anti-wear agent of phosphorus type includes the compounds of the general formulas (V) and (VI).

Compound of the general formula (V)

$$(R-Y)_3-P=X_a$$

wherein R is hydrogen or hydrocarbon groups containing 1 to 20 carbon atoms, preferably linear and branched alkyl groups, aryl groups, aralkyl groups, araryl groups and halogenated hydrocarbon groups; X is oxygen or sulfur; Y is oxygen or sulfur; and a is an integer of 0 or 1.

The compound of the general formula (V) includes those having the following structure (1) to (6).

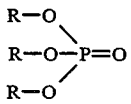

(1)

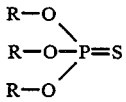

(2)

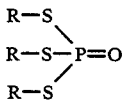

(3)

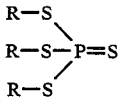

(4)

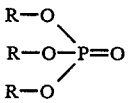

(5)

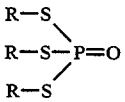

(6)

Examples of the compound having the structure (1) are phosphate esters such as propylphenyl phosphate, butylphenyl phenyl phosphate, ethyl diphenyl phosphate, allyl diphenyl phosphate, ethylphenyl diphenyl phosphate, propylphenyl diphenyl phosphate, butylphenyl diphenyl phosphate, benzyl diphenyl phosphate, cresyl diphenyl phosphate, diethylphenyl phenyl phosphate, dipropylphenyl phenyl phosphate, dibutylphenyl phenyl phosphate, dicresyl phenyl phosphate, triphenyl phosphate, tricresyl phosphate, triethylphenyl phosphate, tripropylphenyl phosphate, tributylphenyl phosphate, dibutyl phosphate and tributyl phosphate; and acid phosphate esters such as lauryl acid phosphate, stearyl acid phosphate and di-2-ethylhexyl phosphate.

Examples of the compound having the structure (2) are triphenyl phophorothionate and butyl methyl diphenyl phosphorothionate.

Examples of the compound having the structure (5) are triisopropyl phosphite and diisopropyl phosphite.

Example of the compound having the structure (6) is trilauryl thiophosphite.

The compound of the general formula (V) is preferably triarylphosphate having the structure (1) and triaryl phosphorothionate having the structure (2), considering the heat stability.

Compound of the general formula (VI)

$$(R-Y_b)_3-P=X_a$$

wherein each R—$Y_b$ group can be identical or different wherein R is hydrogen or hydrocarbon groups containing 1 to 20 carbon atoms, preferably linear and branched alkyl groups, aryl groups, aralkyl groups, araryl groups and halogenated hydrocarbon groups; X is oxygen or sulfur; Y is oxygen or sulfur; a is an integer of 0 or 1; and b is an integer of 0 to 2.

The compound of the general formula (VI) includes those having the following structure (7) to (21).

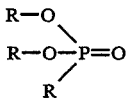
(7)

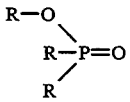
(8)

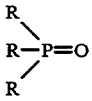
(9)

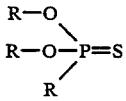
(10)

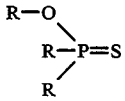
(11)

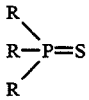
(12)

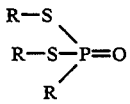
(13)

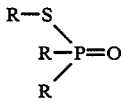
(14)

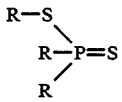
(15)

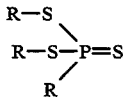
(16)

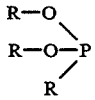
(17)

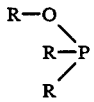
(18)

-continued

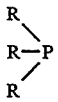
(19)

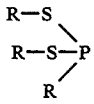
(20)

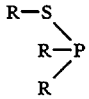
(21)

Compound of the general formula (VII)

$$(R_2N)_a(RO)_b—P=X$$

wherein R is hydrogen or hydrocarbon groups containing 1 to 20 carbon atoms, preferably linear and branched alkyl groups, aryl groups, aralkyl groups, araryl groups and halogenated hydrocarbon groups; X is oxygen or sulfur; a is an integer of 1 to 3; and b is an integer of 0 to 3 provided that a plus b is 3.

The compound of the general formula (VII) includes those having the following structure (22) to (27).

$$(R_2N)_a(RO)_b—P=X$$

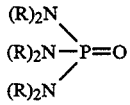
(22)

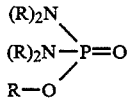
(23)

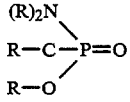
(24)

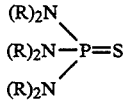
(25)

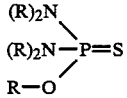
(26)

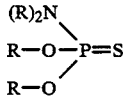
(27)

Example of the compound having the structure (7) is di-n-butylhexyl phosphonate.

Example of the compound having the structure (8) is n-butyl-n-dioctyl phosphinate.

Example of the compound having the structure (22) is hexamethylphosphoric triamide.

Example of the compound having the structure (24) is dibutyl phosphoroamidate.

The known anti-wear agent of sulfur type includes sulfides such as diphenyl sulfide, diphenyl disulfide, dibenzyl disulfide, di-n-butyl sulfide, di-n-butyl disulfide, di-tert-dodecyl disulfide and di-tert-dodecyl trisulfide; sulfurized oils and fats such as sulfurized sperm oil and sulfurized dipentene; thiocarbonates such as xanthic disulfide; and zinc thiophosphates such as zinc primary-alkyl thiophosphate, zinc secondary-alkyl thiophosphate, zinc alkyl aryl thiophosphate and zinc aryl thiophosphate.

In the second composition according to the present invention, the combination of the known anti-wear agents of phosphorus type or sulfur type is contained in organopolysiloxane.

Among various combinations of the known anti-wear agents of phosphorus type or sulfur type, the combination of the anti-wear agent having the structure (1) and the anti-wear agent having the structure (2) is especially preferable. In this combination, the weight ratio of the anti-wear agent having the structure (1) to the anti-wear agent having the structure (2) is suitably 25:75 to 75:25, considering that the changes in viscosity and torque and the weared amount of metal discs, as clear from the example described below.

When the known anti-wear agent of phosphorus type or sulfur type is combined with the storage stabilizer, the anti-wear agent may be singly used. Because the anti-wear agent shows the adsorbability on metals in the temperature range specified depending on its thermal stability, the combined use of two or more anti-wear agent of phosphorus type or sulfur type is mole preferable, whereby such a combination can show the adsorbability over the wide temperature range suitable for various operating conditions of the viscous coupling. Most preferably, the anti-wear agent of phosphorus type is combined with the anti-wear agent of sulfur type.

The anti-wear agent is used in an amount of 0.01 to 5% by weight, preferably 0.1 to 3% by weight of organopolysiloxane. When the used amount of the anti-wear agent is less than 0.01% by weight, the desired effect is not obtained. On the other hand, when it is above 5% by weight, the effect of the anti-wear agent is saturated, whereby there is no meaning using the anti-wear agent in an amount above 5% by weight. When the anti-wear agent of phosphorus type is combined with the anti-wear agent of sulfur type, it is preferably used in an amount of 5 to 95% by weight of the total anti-wear agent.

The storage stabilizer is essentially contained in combined with the known anti-wear agent(s) in the second composition according to the present. If necessary, it may be contained together with the specific anti-wear agent of phosphorus type in the first composition according to the present invention. As the storage stabilizer, the following compounds are exemplified: aliphatic or aromatic amines such as dimethyl-sec-butylamine, methylethyl-n-butylamine, 2,6-di-t-butyl-α-dimethylamino p-cresol and p-aminophenol, as well as their mixture.

The storage stabilizer is used in an amount of 0.001 to 5% by weight, preferably 0.01 to 2% by weight of organopolysiloxane. When the used amount of the metal deactivator is less than 0.001% by weight, the desired effect is not obtained. On the other hand, when it is above 5% by weight, the effect of the storage stabilizer is saturated, whereby there is no meaning using the storage stabilizer in an amount above 5% by weight.

For further improving the thermal stability of the composition according to the present invention, the antioxidant may be contained. As the antioxidant, the following compounds are exemplified: amines such as dioctyl-diphenyl amine, phenyl-α-naphthyl amine, alkyl-diphenyl amine, N-nitroso-diphenyl amine, phenothiazine, N, N'-dinaphthyl-p-phenylene diamine, acridine, N-methylphenothiazine, N-ethyl-phenothiazine, dipyridyl amine, diphenylamine, phenolamine and 2,6-di-t-butyl-α-dimethylamino p-cresol; phenols such as 2,6-di-t-butyl p-cresol, 4,4'-methylene bis(2,6-di-t-butylphenol) and 2,6-di-t-butylphenol; organic iron salts such as iron octoate, ferrocene and iron naphthoate; organic cerium salts such as cerium naphthoate and cerium toluate; organic metal compounds such as zirconium octoate; and their mixture.

The antioxidant is used in an amount of 0.001 to 5% by weight, preferably 0.01 to 2% by weight of organopolysiloxane.

If necessary, the composition according to the present invention may contain the metal deactivator and/or the corrosion inhibitor.

As the metal deactivator, the following compounds are exemplified: benzotriazole and its derivative, benzothiazole and its derivative, triazole and its derivative, dithiocarbamate and its derivative, indazole and its derivative, as well as their mixture.

The metal deactivator is used in an amount of 0.001 to 1.0% by weight, preferably 0.01 to 0.5% by weight of organopolysiloxane. When the used amount of the metal deactivator is less than 0.001% by weight, the desired effect is not obtained. On the other hand, when it is above 1.0% by weight, the resultant composition will contain a large amount of precipitates.

As the corrosion inhibitor, the following compounds are exemplified: isostearate, n-octadecylammonium stearate, diamine dioleate, lead naphthenate, sorbitan oleate, pentaerythrite oleate, oleyl sarcocine, alkylsuccinic acid, alkenylsuccinic acid and their derivatives, and their mixture.

The corrosion inhibitor is used in an amount of 0.001 to 1.0% by weight, preferably 0.01 to 0.5% by weight of organopolysiloxane. When the used amount of the metal deactivator is less than 0.001% by weight, the desired effect is not obtained. On the other hand, when it is above 1.0% by weight, the resultant composition will contain a large amount of precipitates.

Further, the composition according to the present invention may contain any conventional additives such as extreme pressure agent, friction modifier and color-dye agent.

The composition according to the present invention is used mainly for a viscous coupling. It may be used for a fan coupling. Further, it may be used for a shock absorber, a damper, a rashajuster, an automatic transmission, an automatic tentioner and a G-sensor, in which the organopolysiloxane based compositions are used.

Preferable Embodiment of the Invention

In a preferable embodiment of the present invention, the composition comprises organopolysiloxane and a specific anti-wear agent of phosphorus type, optionally together with the antioxidant.

In other preferable embodiment of the present invention, the composition comprises organopolysiloxane and two or more known anti-wear agents of phosphorus type, optionally together with the antioxidant.

In other preferable embodiment of the present invention, the composition comprises organopolysiloxane, at least one known anti-wear agent and the storage stabilizer, optionally together with the antioxidant.

EXAMPLES

The present invention now being fully described, the same will be better understood by reference to certain specific examples which are included herein for purposes of illustration only and are not intended to be limiting of the invention or any embodiment thereof, unless specified.

The materials used in the following examples can be prepared according to any methods known in the art.

Example 1

To dimethylsilicone (viscosity 10000 $mm^2/s$ at 25° C.), 0, 0.1, 0.5 or 1.5% by weight of bis-dithiophosphate ester having the following formula:

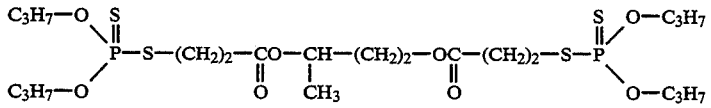

as the anti-wear agent of phosphorus type, optionally together with 1.0% by weight of diphenylamine as the antioxidant was added. The resultant composition was filled in the viscous coupling having 111 discs with a filling degree of 85 vol % at 25° C.

The viscous coupling was placed in a bath kept at 130° C. and was operated at 50 rpm as the differential rotation for 50 hours, after which the changes in viscosity and torque were tested. The results are shown in Table 1.

TABLE 1

| amount of anti-wear agent (wt %) | change in viscosity (%) | change in torque (%) |
|---|---|---|
| 0 | not measurable* | not measurable* |
| 0.1 | +8 | +6 |
| 0.5 | +2 | +2 |
| 1.5 | −3 | −3 |
| 0.5 + antioxidant | +1 | 0 |

*The viscosity and the torque were rapidly increased before 50 hours.

EXAMPLE 2

The composition was prepared according to the procedure as described in Example 1, provided that bis-dithiophosphate was replaced with bis-dithiophosphate having the following formula.

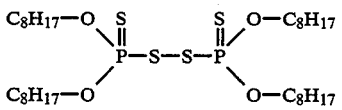

The resultant composition was tested as described in Example 1. The results are shown in Table 2.

TABLE 2

| amount of anti-wear agent (wt %) | change in viscosity (%) | change in torque (%) |
|---|---|---|
| 0 | not measurable | not measurable |
| 0.1 | +5 | +5 |
| 0.5 | +2 | +1 |
| 1.5 | −4 | −4 |
| 0.5 + antioxidant | −1 | −1 |

EXAMPLE 3

The composition was prepared according to the procedure as described in Example 1, provided that bis-dithiophosphate was replaced with dithiophosphate having the following formula.

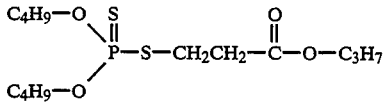

The resultant composition was tested as described in Example 1. The results are shown in Table 3.

TABLE 3

| amount of anti-wear agent (wt %) | change in viscosity (%) | change in torque (%) |
|---|---|---|
| 0 | not measurable | not measurable |
| 0.5 | +5 | +8 |
| 1.0 | +3 | +5 |

EXAMPLE 4

To dimethylsilicone (viscosity 10000 $mm^2/s$ at 25° C.), tricresyl phosphate (A) and triphenyl phosphorotionate (B) in amounts shown in the following table were added. The resultant composition was filled in the viscous coupling having 111 discs with a filling degree of 85 vol % at 25° C.

The viscous coupling was placed in a bath kept at 150° C. and was operated at 35 rpm for 100 hours, after which the changes in viscosity and torque were tested. The amount of iron powder produced by wearing was determined by atomic absorption spectrophotometry after dry ashing and acid decomposition. The residual amount of the anti-wear agents added was measured by isolating the anti-wear agents from the composition after 100 hours operating and then chromatographically determining the anti-wear agents residued in the composition. The results are shown in Table 4.

TABLE 4

| amount of anti-wear agent (wt %) | | change in viscosity | change in torque | weared amount | residual amount |
|---|---|---|---|---|---|
| A | B | (%) | (%) | (%) | (%) |
| 0 | 1.0 | +7 | +7 | 0.02 | 50 |
| 0.1 | 0.9 | +6 | +5 | 0.02 | 55 |
| 0.3 | 0.7 | −2 | −3 | 0.01 | 70 |
| 0.4 | 0.6 | −2 | −1 | 0.01 | 75 |
| 0.6 | 0.4 | +1 | +1 | 0.01 | 75 |
| 0.7 | 0.3 | +2 | +3 | 0.01 | 75 |
| 0.9 | 0.1 | +5 | +5 | 0.03 | 38 |
| 1.0 | 0 | +7 | +6 | 0.04 | 35 |

EXAMPLE 5

To dimethylsilicone (viscosity 50000 $mm^2/s$ at 25° C.), tricresyl phosphate (A) as the anti-wear agent of phosphorus type and 2,6-di-t-butyl-α-dimethylamino p-cresol (B) as the storage stabilizer in amounts shown in the following table were added. The resultant composition was killed in the viscous coupling having 111 discs with a filling degree of 85 vol % at 25° C.

The viscous coupling was placed in a bath kept at 150° C. and was operated at 25 rpm for 200 hours, after which the changes in viscosity and torque were tested. The results are shown in Table 5.

TABLE 5

| amount of anti-wear agent (wt %) | | change in viscosity | change in torque |
|---|---|---|---|
| A | B | (%) | (%) |
| 1.0 | — | +10 | +9 |
| — | 1.0 | not measurable* | not measurable* |
| 1.0 | 0.1 | +4 | +5 |
| 1.0 | 0.5 | −1 | +1 |
| 0.5 | 0.5 | +3 | +3 |

*The viscosity and the torque were rapidly increased before 200 hours.

Example 6

The composition was prepared according to the procedure as described in Example 5, provided that tricresyl phosphate was replaced with triphenylphosphorothionate (C) as the anti-wear agent of phosphorus type. The resultant composition was tested as described in Example 5. The results are shown in Table 6.

TABLE 6

| amount of anti-wear agent (wt %) | | change in viscosity | change in torque |
|---|---|---|---|
| C | B | (%) | (%) |
| 1.0 | — | +5 | +6 |
| 1.0 | 0.1 | +3 | +3 |
| 1.0 | 0.5 | 0 | −1 |
| 0.5 | 0.5 | +2 | +2 |

EXAMPLE 7

The composition was prepared according to the procedure as described in Example 5, provided that tricresyl phosphate was replaced with a mixture of tricresyl phosphate (A) and triphenylphosphorothionate (C) in a weight ratio of 1:1 as the anti-wear agent of phosphorus type. The resultant composition was tested as described in Example 5. The results are shown in Table 7.

TABLE 7

| amount of anti-wear agent (wt %) | | change in viscosity | change in torque |
|---|---|---|---|
| A + B | B | (%) | (%) |
| 1.0 | — | +3 | +4 |
| 1.0 | 0.1 | +2 | +2 |
| 1.0 | 0.5 | 0 | 0 |
| 0.5 | 0.5 | −1 | −1 |

We claim:

1. A composition for use in a viscous coupling, comprising an organopolysiloxane having a viscosity of 1,000 to 300,000 cSt at 25° C. and of the formula:

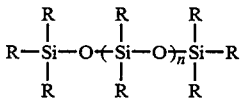

wherein each R represents a hydrocarbon group containing 1 to 18 carbon atoms, which may be halogenated, and n is an integer of 1 to 3,000: and, as an anti-wear agent, at least one compound of formulas (I) to (IV) alone or together with a storage stabilizer:

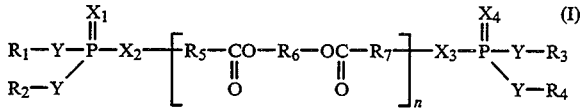

(I)

wherein each of $R_1$ to $R_4$ is hydrogen or a monovalent hydrocarbon group containing 1 to 20 carbon atoms; each of $R_5$ to $R_7$ is a divalent hydrocarbon group containing 1 to 6 carbon atoms; each of $X_1$ to $X_4$ is oxygen or sulfur; Y is either a direct bond or oxygen or sulfur; and n is an integer of 0 to 2, provided that both $X_2$ and $X_3$ are sulfur when n is 0;

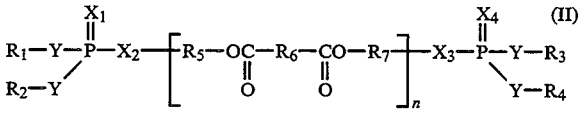

(II)

wherein $R_1$ to $R_7$, $X_1$ to $X_4$, Y and n are as defined in formula (I):

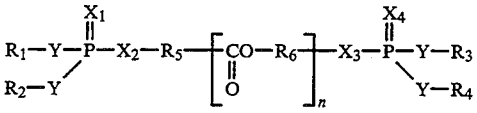

(III)

wherein each of $R_1$ to $R_4$ is hydrogen or a monovalent hydrocarbon group containing 1 to 20 carbon atoms; each of $R_5$ and $R_6$ is a divalent hydrocarbon group containing 1 to 6 carbon atoms; each of $X_1$ to $X_4$ is oxygen or sulfur; and Y is either a direct bond or oxygen or sulfur; and n is an integer of 0 to 2,

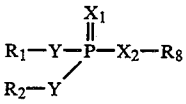

(IV)

wherein each of $R_1$ and $R_2$ is hydrogen or a monovalent hydrocarbon group containing 1 to 20 carbon atoms; $R_8$ is a hydrocarbon group containing 1 to 20 carbon atoms and containing at least one ester bond; each of $X_1$ and $X_2$ is oxygen or sulfur; and Y is either a direct bond or oxygen or sulfur.

2. The composition according to claim 1, which further includes an antioxidant.

* * * * *